United States Patent [19]

Dröscher et al.

[11] Patent Number: 4,578,627

[45] Date of Patent: Mar. 25, 1986

[54] DEVICE FOR CORRECTING THE CONTROL OR THE DISPLAY OF THE POSITION OF A CUTTING TOOL OF A CUTTING MACHINE

[75] Inventors: Bernhard Dröscher; Alfred Zitz, both of Zeltweg, Austria

[73] Assignee: Voest-Alpine Aktiengesellschaft, Muldenstrasse, Austria

[21] Appl. No.: 622,248

[22] Filed: Jun. 19, 1984

[30] Foreign Application Priority Data

Jul. 15, 1983 [AT] Austria ..... 2606/83

[51] Int. Cl.[4] ..... E21C 47/00

[52] U.S. Cl. ..... 318/632; 299/39; 318/648

[58] Field of Search ..... 318/632, 648; 83/928, 83/240, 353, 368, 472, 473, 477, 527; 299/36, 39; 172/706, 714, 722

[56] References Cited

U.S. PATENT DOCUMENTS 3,325,927 6/1967 Mullin ..... 299/36
3,405,257 10/1968 Rantsch ..... 318/632 X
3,415,574 12/1968 Lauber ..... 175/76
3,906,323 9/1975 Ono ..... 318/632 X
4,070,064 1/1978 Cobb ..... 299/36 X
4,499,546 2/1985 Kuga ..... 318/632 X

FOREIGN PATENT DOCUMENTS 339235 2/1977 Austria .
1758833 3/1971 Fed. Rep. of Germany .

*Primary Examiner*—William M. Shoop, Jr.
*Assistant Examiner*—Patrick C. Keane
*Attorney, Agent, or Firm*—Cushman, Darby & Cushman

[57] ABSTRACT

With cutting machines, having their loading means (7) adapted to be lowered below the running surfaces (11) of the crawlers (2) of the drift advancing machine, there results an erroneous position of the machine on account of lifting the front end of the machine during such lowering movement of the loading means (7). For establishing the correct position of the cutting tool (6) and of the cutting arm (5), corrective signal are used which are released by angular position transmitters (16 or 17, respectively). By means of these angular position transmitters (16 or 17, respectively), the swivelling angle of the loading means (7) relative to the frame (1) or the swivelling angle $\theta$ of the operating cylinder (9) of the loading means (7) relative to the frame (1), respectively, is measured and the required corrective signal for the angle advance $\Delta\alpha$ is calculated (FIG. 3).

9 Claims, 3 Drawing Figures

Figure 1:
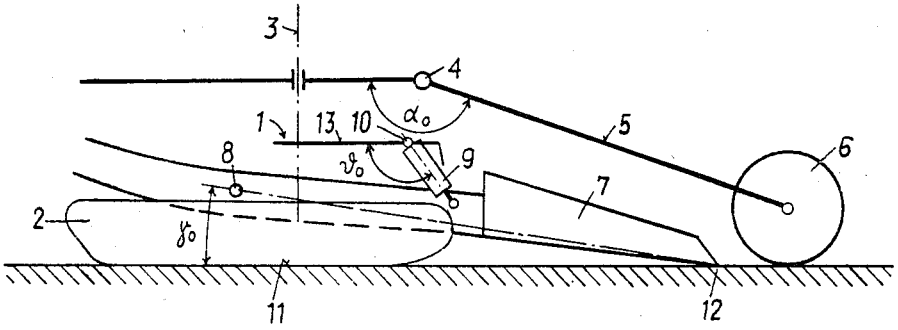

DEVICE FOR CORRECTING THE CONTROL OR THE DISPLAY OF THE POSITION OF A CUTTING TOOL OF A CUTTING MACHINE

The invention refers to a device for correcting the control or the display of the position of a cutting tool of a cutting machine, which cutting machine has a loading means by means of which the front end of the machine, in particular the crawlers of the chassis in their forward area, can be lifted off the floor. With such partial cut cutting machines, the cutting tool is rotatably supported on a universally swivelable cutting arm, and it is already known to represent the position of the cutting tool relative to the frame of the cutting machine on a display means comprising the nominal profile to be cut, for example in form of a templet. For correctly matching the nominal profile, it has already been proposed to detect the position of the cutting machine relative to a drift pilot ray and to consider erroneous positions of the machine resulting from detecting the position relative to a pilot ray for displaying or controlling, respectively, the movement of the cutting tool. In more simple cases, the machine is, however, used independent of its position relative to a pilot ray and with such a procedure it is possible to match, starting from a certain selected position of the cutting machine, a definite nominal profile with consideration of the swivelling angle of the cutting machine.

There have become known cutting machines of the initially mentioned type in which the loading means can, for the purpose of increasing the stability during cutting operation, be lowered below the plane of the travelling surfaces of the machine whereby the front end of the machine is lifted. With such devices, the display means would be responsible for erroneously controlling the cutting tools if any change of the position of the cutting machine, in particular any lifting of the cutting machine at its front end, would not additionally be taken in consideration.

The invention now aims at providing a simple device of the initially mentioned type, with which erroneous positions resulting when lifting the front part of the machine by a loading means can be compensated and with which the predetermined nominal profile can reliably be matched during cutting operation. For solving this task, the invention essentially consists in that an angular position transmitter is provided for transmitting the position of the loading means or of a part connected therewith, relative to the frame of the cutting machine, the signals of said transmitter being transmitted to an evaluating circuit, in particular a computing device, for correcting the display of the height position of the cutting tool or for controlling this height position with consideration of the machine geometry. On account of an angular position transmitter transmitting the position of the loading means relative to the frame of the cutting machine being provided, the extent of adjustment of the frame of the cutting machine can be determined with consideration of the geometry of the linking arrangement of the loading ramp to the frame and of the cutting arm to the machine, and the display means and the control of the position of the cutting tool can correspondingly be corrected.

In a particularly simple manner, the arrangement is, according to the invention, such that the angular position transmitter is formed of an angle measuring device, in particular an angle coding means or inclinometer connected with the operating cylinder of the loading means or with the frame or with the loading means at its pivotal axis for swivelling same relative to the frame.

In particular when using electric or electronic display means or control means, respectively, the evaluating circuit preferably comprises a memory in which is stored, in correspondence with the machine geometry, the mathematical relationship of the angle of the loading means to the frame to the needed angular correction of the cutting arm. Consideration of the machine geometry is, in this case, necessary in particular because the linking axis of the loading ramp is, as a rule, different from the linking axis of the cutting arm and thus a certain angle of inclination of the loading ramp relative to the frame results in a deviating angle, being different from said angle, in the position of the cutting arm if the frame of the cutting machine is lifted. In this case, the evaluating circuit preferably comprises at least one comparator which transmits, after having adjusted a predetermined angle between frame and loading means, the signal of the angular position transmitter or the corresponding corrective signal for the angle of elevation of the cutting tool, respectively, to the control means of the cutting arm or to the display means.

In the following, the invention is further illustrated with reference to an embodiment shown in the drawing.

In the drawing

Figure 2:
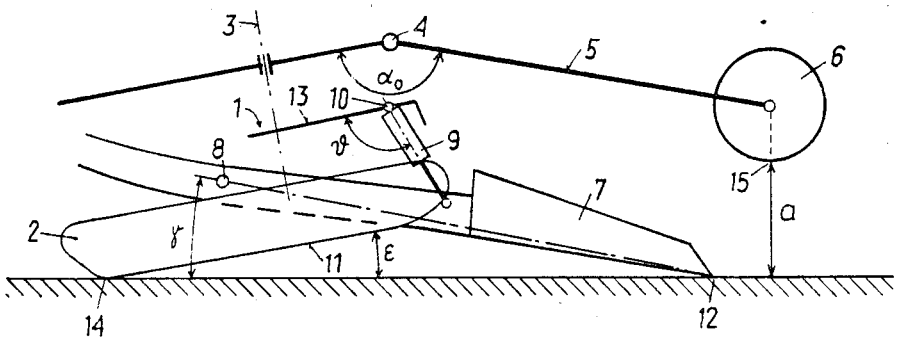
Figure 3:
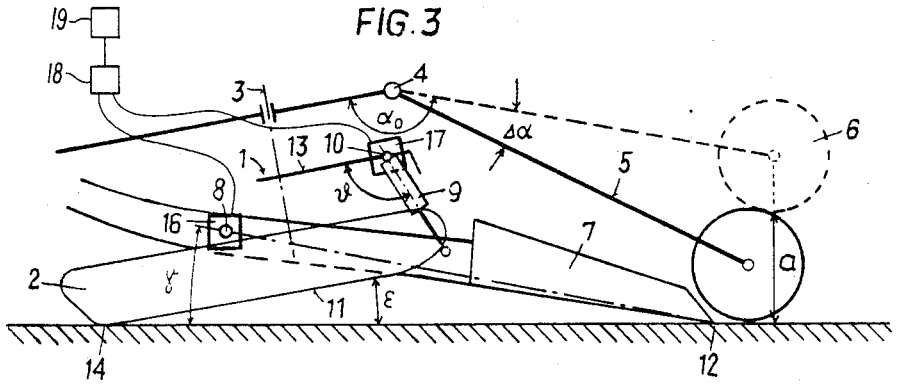

FIG. 1 shows a schematic side elevation of a cutting machine together with a loading means lowered below the running surface of the crawlers of the chassis, FIG. 2 shows the machine of FIG. 1 after having lifted the front end of the crawler chassis and FIG. 3 shows the in this case required correction of the position of the cutting arm schematically in a side elevation.

In FIG. 1, the frame of the cutting machine is designated by 1. The cutting machine has crawlers 2 by means of which the cutting machine can be moved within the drift cross section. A traversing gear is supported on a tower for rotation around a substantially vertical axis 3 and a cutting arm 5 is pivotally linked to the traversing gear so as to be swivelable around a substantially horizontal axis 4. The cutting arm 5 carries cutting heads 6 by means of which can be cut the rock to be excavated. A loading means 7 can be swivelled on the frame 1 of the cutting machine around a substantially horizontal axis 8, an operating cylinder 9 being pivotally linked to the frame 1 at 10 for swivelling the loading ramp 7. In the representation of FIG. 1, the cutting machine assumes a position in which the loading ramp is not lowered below the running surface 11 of the crawlers 2. In the shown position of the cutting head 6, in which the cutting head contacts the floor of the drift, the cutting arm 5 is swivelled for an angle $\alpha_o$ relative to the traversing gear. The straight line connecting the linking axis 8 with the tip 12 of the loading ramp 7 includes an angle $\gamma_o$ with the running surface 11 of the crawlers. The operating cylinder 9 of the loading ramp 7 includes an angle $\delta_o$ with a horizontal plane 13. In the representation of FIG. 2, the operating cylinder 9 is pressurized by pressurized fluid, so that the loading ramp 7 is moved below the running surface 11 of the crawler chassis. The front end of the machine and thus the running surface 11 is thus swivelled for an angle $\epsilon$ with respect to the point 14 or rotation located at the rear area of the crawler chasis, the angle between the plane 13 and the operating cylinder now assuming the value $\theta$. Without any correction of the angle $\alpha_o$ for the swivelled position of the cutting arm 5, there would, in this case, result lifting of the cutting head for a distance a and thus a mal-position relative to the nominal profile. The point 15 of the cutting head 6 originally contacting the floor is thus lifted for this distance a, this lifting distance a being proportional to sin $\epsilon$. The connecting line between the linking axis 8 and the tip 12 of the loading means 7 includes now an angle $\gamma=\gamma_o+\Delta\gamma$ with the running surface 11.

In this case, there apply the following equations $$\underline{a}=\overline{14,\ 15}\cdot\sin\epsilon$$

$$\underline{a}=\overline{14,\ 15}\cdot\sin k_1\Delta\gamma$$

$$\underline{a}=\overline{14,\ 15}\cdot\sin k_2\Delta\theta$$

$$\epsilon=k_1\Delta\gamma=k_2\Delta\theta$$

$$\theta=\theta_o+\Delta\theta$$

From these equations, in which $\overline{14,\ 15}$ means the distance between the points 14 and 15, it can clearly be derived, that a number of coefficients of proportionality typical for the machine, in particular $k_1$ and $k_2$, must be considered for reliably obtaining the correct position of the cutting head, i.e. a descending movement of the head 6 in direction to the floor for the distance a. The required corrective angle $\Delta\alpha$ can be taken from FIG. 3, in which the mal-position of the cutting head 6 is shown in dashed lines and the correct position relative to the nominal profile to be established is shown in full lines.

The angular position transmitter required for detecting the erroneous position or mal-position can act either on the swivelling axis 8 or on the swivelling axis 10 and is schematically indicated in FIG. 3 by 16 and 17. The angular position transmitter 16 can measure the angle $\gamma$ relative to the frame 1 of the machine, whereas the angular position transmitter 17 can measure the angle $\theta$ relative to the horizontal plane 13. The transmitter 16, 17 is connected to an evaluating circuit 18 which is connected to a display 19 of the height position of the cutting tool.

What is claimed is:

1. A device for controlling the angular position of a cutting tool mounted on a cutting machine, the cutting machine being self-propelled and including a loading means for removing cut debris having a front end and a rear end and pivotally mounted about a horizontal axis on a frame of the cutting machine spaced from the front end of the loading means, the loading means capable of engaging the ground to stablilize the cutting machine such that the front end of said cutting machine is lifted from the ground, the cutting tool being mounted on an arm pivotally mounted about a horizontal axis on the cutting machine, the cutting tool being capable of engaging the ground, an angular position transmitter means capable of detecting and transmitting a signal indicating the angular position of the loading means relative to the frame, an evaluating circuit means capable of receiving said signal and adjusting the angular position of the cutting tool to maintain a predetermined position.

2. A device according to claim 1 wherein the angular position transmitter means includes an angle measuring means.

3. A device according to claim 1 wherein the loading means is raised and operated by a pressure operated cylinder and said angular position transmitter means measures the angle between the longitudinal axis of the pressure operated cylinder and the frame.

4. A device according to claim 2 wherein said angle measuring means comprises an angle coding means.

5. A device according to claim 2 wherein said angle measuring means comprises an inclinometer.

6. A device according to claim 1 wherein the evaluating circuit means includes a memory capable of storing a value corresponding to the angle of the loading means to the frame.

7. A device according to claim 1 wherein the evaluating circuit means determines a corrective angle for the angle of the cutting tool to the frame with a change in the angle of the loading means to the frame whereby the position of the cutting tool with respect to the surface being cut remains unchanged.

8. A device according to claim 1 wherein the evaluating circuit means includes at least one comparator for transmitting a corrective signal to a control means for the cutting arm.

9. A self-propelled cutting machine for use in a mine comprising a frame member, a loading means for removing cut debris from the mine having a front end and a rear end, the loading means being pivotally mounted on the frame about a horizontal axis, the front end of the loading means capable of stabilizing the cutting machine by engaging the ground whereby the front end of the cutting machine is raised from the ground, the cutting machine further including a cutting tool capable of engaging a mine face, the cutting tool being mounted on a cutting arm, the cutting arm being pivotally mounted to the cutting machine and operated by a control means, an angular position transmitter capable of detecting and transmitting a first signal indicating the angular position of the loading means relative to the frame, an evaluating circuit means including a comparator capable of receiving said first signal and capable of transmitting a corrective signal to the control means of the cutting arm to adjust the angular position of the cutting arm whereby the position of the cutting tool remains with respect to a predetermined position on the mine face with a change when the front of the cutting machine is raised from the ground.

* * * * *